US010240822B2

(12) United States Patent
Ozaki et al.

(10) Patent No.: US 10,240,822 B2
(45) Date of Patent: Mar. 26, 2019

(54) THERMOACOUSTIC HEATING DEVICE

(71) Applicant: ISUZU MOTORS LIMITED, Tokyo (JP)

(72) Inventors: Shou Ozaki, Fujisawa (JP); Yasushi Yamamoto, Chigasaki (JP)

(73) Assignee: ISUZU MOTORS LIMITED, Tokyo (JP)

( * ) Notice: Subject to any disclaimer, the term of this patent is extended or adjusted under 35 U.S.C. 154(b) by 363 days.

(21) Appl. No.: 15/029,076

(22) PCT Filed: Oct. 17, 2014

(86) PCT No.: PCT/JP2014/077693
§ 371 (c)(1),
(2) Date: Apr. 13, 2016

(87) PCT Pub. No.: WO2015/060214
PCT Pub. Date: Apr. 30, 2015

(65) Prior Publication Data

US 2016/0231028 A1 Aug. 11, 2016

(30) Foreign Application Priority Data

Oct. 23, 2013 (JP) ..... 2013-220062

(51) Int. Cl.
*F25B 27/02* (2006.01)
*F25B 9/14* (2006.01)

(52) U.S. Cl.
CPC ..... *F25B 9/145* (2013.01); *F25B 27/02* (2013.01); *F02G 2243/52* (2013.01);
(Continued)

(58) Field of Classification Search
CPC .. F02G 2243/52; F02G 2243/54; F25B 9/145; F25B 2309/1402–2309/1406; F25B 2309/1409
See application file for complete search history.

(56) References Cited

U.S. PATENT DOCUMENTS

2006/0185370 A1* 8/2006 Watanabe ..... F25B 9/145 62/6
2007/0221367 A1 9/2007 Watanabe et al.
(Continued)

FOREIGN PATENT DOCUMENTS

JP 2005-274099 10/2005
JP 2007-147192 6/2007
(Continued)

OTHER PUBLICATIONS

International Preliminary Report on Patentability dated Apr. 26, 2016 in corresponding International Patent Application No. PCT/JP2014/077693.
(Continued)

*Primary Examiner* — Keith M Raymond
*Assistant Examiner* — Nael N Babaa
(74) *Attorney, Agent, or Firm* — Staas & Halsey LLP

(57) ABSTRACT

A thermoacoustic heating device capable of effectively utilizing streaming, and including a prime mover in a first pipeline that forms a loop line, and a heating device in a second pipeline that forms another loop line. The first and second pipelines are connected to each other via a branch pipeline. A branch pipeline on the prime mover side and the second pipeline on the heating device side are positioned adjacent to each other, and a low-temperature side heat exchanger of the heating device is integrally formed with or held in contact with the branch pipeline on the prime mover side.

5 Claims, 2 Drawing Sheets

(52) U.S. Cl.
CPC .. *F02G 2243/54* (2013.01); *F25B 2309/1402* (2013.01); *F25B 2309/1403* (2013.01); *F25B 2309/1404* (2013.01); *F25B 2309/1405* (2013.01); *F25B 2309/1409* (2013.01); *F25B 2309/1425* (2013.01)

(56) References Cited

U.S. PATENT DOCUMENTS

| | | | | |
|---|---|---|---|---|
| 2008/0110180 | A1* | 5/2008 | Watanabe ..... | F02F 3/003 62/6 |
| 2011/0259003 | A1 | 10/2011 | Yamamoto | |

FOREIGN PATENT DOCUMENTS

| | | | |
|---|---|---|---|
| JP | 2007-292326 | | 11/2007 |
| JP | 2011-002119 | | 1/2011 |
| JP | 2011-127870 | | 6/2011 |
| JP | 2011127870 | A * | 6/2011 |
| JP | 2011-231941 | | 11/2011 |
| JP | 2013-50087 | | 3/2013 |

OTHER PUBLICATIONS

Extended European Search Report for corresponding European Patent Application No. 14855495.9, dated Sep. 12, 2017.
J-PlatPat English Abstract for JP 2007-147192, published Jun. 14, 2007.
J-PlatPat English Abstract for JP 2007-292326, published Nov. 8, 2007.
J-PlatPat English Abstract for JP 2011-002119, published Jan. 6, 2011.
Espacenet Bibliographic data, Publication No. 2011-127870, published Jun. 30, 2011.
Espacenet Bibliographic data, Publication No. 2013-50087, published Mar. 14, 2013.
International Search Report dated Jan. 6, 2015, in corresponding International Application No. PCT/JP2014/077693.

* cited by examiner

THERMOACOUSTIC HEATING DEVICE

CROSS-REFERENCE TO RELATED APPLICATIONS

This application is a U.S. National Stage Application, which claims the benefit under 35 U.S.C. § 371 of PCT International Patent Application No. PCT/JP2014/077693, filed Oct. 17, 2014, which claims the foreign priority benefit under 35 U.S.C. § 119 of Japanese Patent Application No. 2013-220062, filed Oct. 23, 2013, the contents of which are incorporated herein by reference.

TECHNICAL FIELD

The present invention relates to a thermoacoustic heating device and, in particular, to a thermoacoustic heating device capable of effectively utilizing streaming that occurs in a pipeline.

BACKGROUND ART

A variety of types of conventional thermoacoustic engines have been hitherto proposed that include a single-loop type as shown in FIG. 3, a double-loop type as shown in FIG. 4, and the like (Patent Literature Documents 1 to 3).

A single-loop type thermoacoustic engine 30 shown in FIG. 3 includes a prime mover 32 and a heating device 33 both provided in a loop pipeline 31. The prime mover 32 is made up of a high-temperature side heat exchanger 34, a low-temperature side heat exchanger 35, and a stack 36 for connecting the high-temperature side heat exchanger 34 to the low-temperature side heat exchanger 35. The heating device 33 is made up of a high-temperature side heat exchanger 37, a low-temperature side heat exchanger 38, and a stack 39 for connecting the high-temperature side heat exchanger 37 to the low-temperature side heat exchanger 38.

A double-loop thermoacoustic engine 40 shown in FIG. 4 includes two loop pipelines 41 and 42, a branch pipeline 43 employed as a resonance pipe for connecting the loop pipeline 41 to the loop pipeline 42, a prime mover 32 provided in the loop pipeline 41, and a heating device 33 provided in the loop pipeline 42. As described in conjunction with FIG. 3, each of the prime mover 32 and the heating device 33 is made up of a high-temperature side heat exchanger 34 or 37, a low-temperature side heat exchanger 35 or 38, and a stack 36 or 39 for connecting the high-temperature side heat exchangers 34 or 37 and the low-temperature side heat exchanger 35 or 38.

In the thermoacoustic engines 30 and 40 as shown in FIGS. 3 and 4, the prime mover 32 is supplied with waste heat to maintain a desired temperature difference between the temperature of the high-temperature side heat exchanger 34 and that of the low-temperature side heat exchanger 35 to thereby generate acoustic waves from the low-temperature side heat exchanger 35. The acoustic waves so generated are then transmitted to the high-temperature side heat exchanger 34 via the stack 36. The acoustic waves are further transmitted to the heating device 33 via the loop pipeline 31 or the loop pipelines 41 and 42 and the branch pipeline 43 to maintain the low-temperature side heat exchanger 38 of the heating device 33 at a desired temperature. By doing so, the high-temperature side heat exchanger 37 can be utilized as a heat source.

When the heating device is used for a refrigerating machine, the low-temperature side heat exchanger can be utilized as a cold source by maintaining the high-temperature side heat exchanger at a desired temperature. Electrical energy can be obtained by connecting a linear generator to the pipeline.

LISTING OF REFERENCES

PATENT LITERATURE DOCUMENT 1: Japanese Patent Application Laid-Open Publication No. 2005-274099

PATENT LITERATURE DOCUMENT 2: Japanese Patent Application Laid-Open Publication No. 2011-231941

PATENT LITERATURE DOCUMENT 3: Japanese Patent Application Laid-Open Publication No. 2011-127870

PATENT LITERATURE DOCUMENT 4: Japanese Patent Application Laid-Open Publication No. 2013-050087

In a thermoacoustic engine, an overall flow of a fluid in a pipeline generates a mass flow, which is referred to as streaming.

Conventional thermoacoustic engines have been designed to generate the least streaming for improvement in efficiency of a prime mover. Because the streaming is generated due to an excessive output within the devices, they are designed to reduce the output in order to reduce the generation of the streaming, or the generation of the streaming can be reduced to a certain extent by designing the devices so as to correspond with the output. However, such designs pose a problem of increasing the size of the devices.

In order to reduce the streaming, a member such as a rubber membrane is installed in a pipeline to block the streaming (Patent Literature Document 4), but the rubber membrane is a movable member and accordingly problematic in terms of durability. In addition, the rubber membrane poses a problem of impeding propagation of acoustic waves.

In applications where a thermoacoustic engine is used for a refrigerating machine or used to generate electricity, the streaming acts to transport heat from the prime mover to the refrigerating machine, thus causing a drop in efficiency. For this reason, it is a common practice to generate as little streaming as possible. However, in applications where the thermoacoustic engine is used as a heating device, it is preferred that the streaming be generated in an intended fashion because the temperature can be increased more efficiently by transporting heat from the prime mover to the heating device.

SUMMARY OF THE INVENTION

An object of the present invention is to overcome the above-described problems and provide a thermoacoustic heating device capable of effectively utilizing streaming.

In accomplishing the above objective, the present invention is directed to a thermoacoustic heating device including a pipeline formed into a loop and having a first pipeline and a second pipeline, a prime mover provided in the first pipeline, and a heating device provided in the second pipeline. The pipeline is configured such that the first pipeline on a prime mover side and the second pipeline on a heating device side are positioned adjacent to each other, and a low-temperature side heat exchanger of the heating device is integrally formed with or held in contact with the first pipeline on the prime mover side.

The pipeline formed into a loop may be a double-loop having two loop pipelines connected to each other by a branch pipeline. In this configuration, the prime mover may be provided in one of the two loop pipelines, and the heating device may be provided in the other of the two loop pipelines. The branch pipeline may be bent at an intermediate portion thereof into a U-shape in such a manner that the loop pipeline on the heating device side may be positioned adjacent to the branch pipeline on the prime mover side, and the low-temperature side heat exchanger of the heating device may be integrally formed with or held in contact with the branch pipeline on the prime mover side.

The present invention according to another aspect is directed to a thermoacoustic heating device including a pipeline formed into a loop and having a first pipeline and a second pipeline, a prime mover provided in the first pipeline, and a heating device provided in the second pipeline. The pipeline includes a single-loop and is configured by bending a portion thereof into an additional loop in such a manner that the first pipeline on a prime mover side and the second pipeline on a heating device side are positioned adjacent to said additional loop, and a low-temperature side heat exchanger of the heating device is integrally formed with or held in contact with the first pipeline on the prime mover side.

The present invention exerts a beneficial effect of being able to effectively utilize heat generated by streaming. Heat generated by streaming has been hitherto considered unnecessary.

MODE FOR CARRYING OUT THE INVENTION

Preferred embodiments of the present invention are described below in detail with reference to the drawings.

Figure 1:
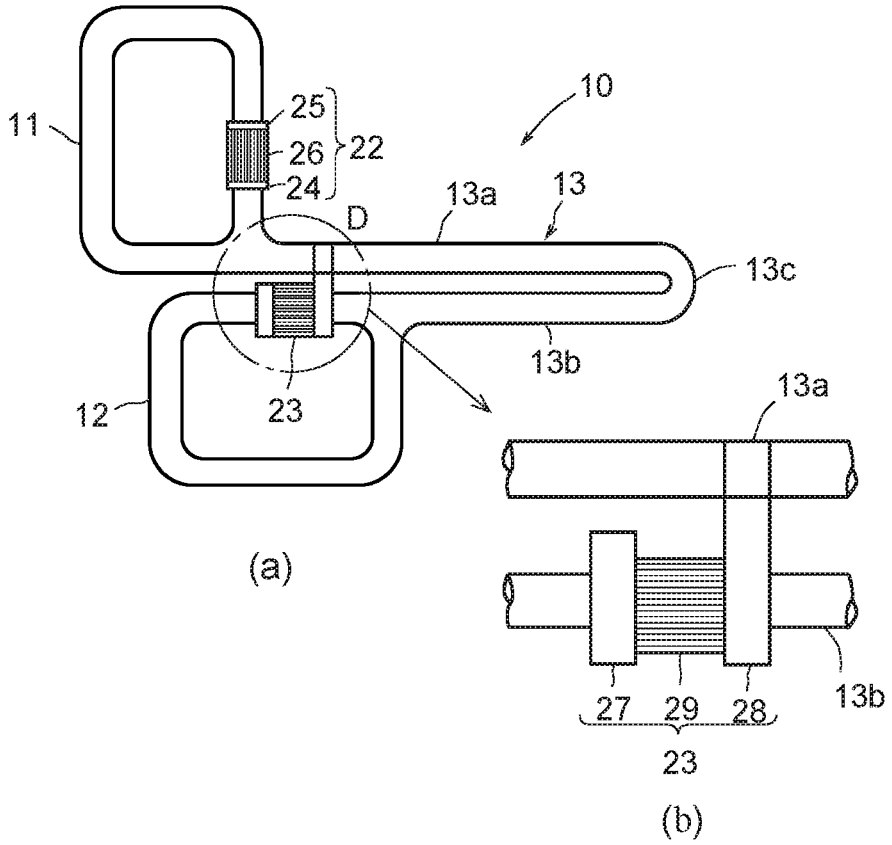
FIG. 1 is a set of views showing an embodiment of the present invention. Specifically, FIG. 1(*a*) is an overall view thereof, and FIG. 1(*b*) is a detail view of a portion D circled in FIG. 1(*a*).

FIG. 1 illustrates a thermoacoustic heating device 10 according to the embodiment of the present invention with a loop-shaped pipeline formed into a double-loop. The loop-shaped pipeline is formed by connecting two loop pipelines 11 and 12 using a branch pipeline 13. The branch pipeline 13 is employed as a resonance pipe. The thermoacoustic heating device 10 includes a prime mover 22 provided in the loop pipeline 11 and a heating device 23 provided in the loop pipeline 12.

The prime mover 22 includes a high-temperature side heat exchanger 24, a low-temperature side heat exchanger 25, and a stack 26 for connecting the high-temperature side heat exchanger 24 to the low-temperature side heat exchanger 25. Similarly, the heating device 23 includes a high-temperature side heat exchanger 27, a low-temperature side heat exchanger 28, and a stack 29 for connecting the high-temperature side heat exchanger 27 to the low-temperature side heat exchanger 28.

The branch pipeline 13 is bent at an intermediate portion thereof into a U-shape in such a manner that a branch pipeline 13*a* on the prime mover 22 side and another branch pipeline 13*b* on the heating device 23 side are disposed adjacent to each other. A bent portion 13*c* is formed such that the branch pipeline 13*a* on the prime mover 22 side is longer than the branch pipeline 13*b* on the heating device 23 side, and the loop pipeline 12 having the heating device 23 provided therein is positioned adjacent to the branch pipeline 13*a* on the prime mover 22 side.

In this embodiment, the low-temperature side heat exchanger 28 of the heating device 23 is configured so as to be integrally formed with or held in contact with the branch pipeline 13*a* on the prime mover 22 side.

The operation of this embodiment will now be described.

Exhaust gas from, for example, an engine is employed as a working fluid and is caused to flow into the high-temperature side heat exchanger 24 of the prime mover 22 provided in the loop pipeline 11, and the low-temperature side heat exchanger 25 is caused to have a temperature difference of about 100 degrees C. relative to the high-temperature side heat exchanger 24, thereby generating acoustic waves from the low-temperature side heat exchanger 25 through the stack 26 and the high-temperature side heat exchanger 24. Such acoustic waves are then transmitted to the loop pipeline 12 via the branch pipeline 13.

In the heating device 23, the low-temperature side heat exchanger 28 is caused to have a desired temperature to allow the high-temperature side heat exchanger 27 to obtain a temperature higher than the temperature of the low-temperature side heat exchanger 28 by more than 100 degrees C. Another working fluid flowing into the high-temperature side heat exchanger 27 can be used as a heat source for another device such as an SCR device (Selective Reduction Catalytic device) or a DPF (Diesel Particulate Filter) connected to an engine exhaust gas system.

In this instance, streaming occurs in the prime mover 22, but the low-temperature side heat exchanger 28 of the heating device 23 can receive heat generated by the streaming because the low-temperature side heat exchanger 28 is integrally formed with or held in contact with the branch pipeline 13*a* of the prime mover 22 side. Thus, it is possible to suppress the streaming that flows into the branch pipeline 13*a* on the downstream side thereof and also allow the high-temperature side heat exchanger 27 to recover the heat generated by the streaming.

In this manner, the heat generated by the streaming can be utilized, and therefore this embodiment can reduce the volume of the prime mover 22.

Another embodiment of the present invention will be described with reference to FIG. 2.

Figure 2:
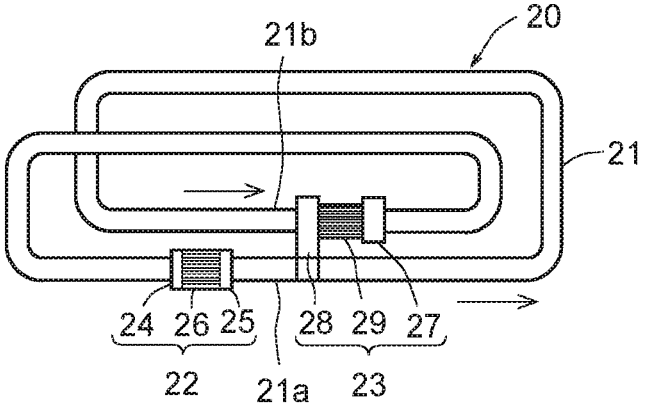
FIG. 2 is a view showing another embodiment of the present invention.
Figure 3:
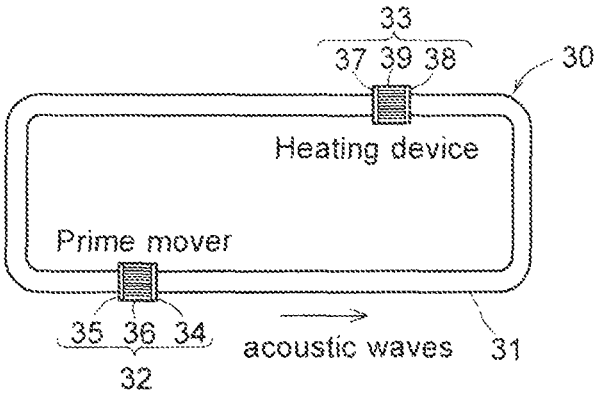
FIG.3 PRIOR ART
FIG. 3 is a view showing a conventional single-loop type thermoacoustic heating device.
Figure 4:
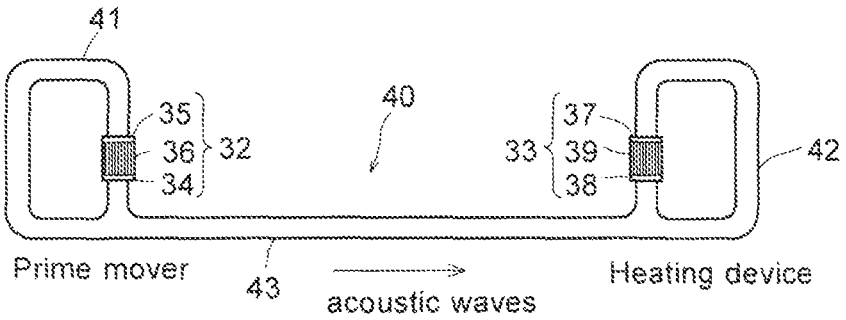
FIG.4 PRIOR ART
FIG. 4 is a view showing a conventional double-loop type thermoacoustic heating device.

FIG. 2 shows a thermoacoustic heating device 20 according to the second embodiment of the present invention with a loop-shaped pipeline formed into a single-loop.

The loop pipeline of this thermoacoustic heating device 20 is configured by bending a portion of a single-loop pipeline 21 into an additional loop, and the thermoacoustic heating device 20 includes a prime mover 22 and a heating device 23 provided in pipelines 21*a* and 21*b*, respectively.

In this embodiment, when the pipeline 21*a* having the prime mover 22 provided therein and the pipeline 21*b* having the heating device 23 provided therein are formed, the pipeline 21*a* on the prime mover 22 side and the pipeline 21*b* on the heating device 23 side are positioned adjacent to each other, and the low-temperature side heat exchanger 28 of the heating device 23 is configured so as to be integrally formed with or held in contact with the pipeline 21*a* on the prime mover 22 side.

In this embodiment also, the exhaust gas from, for example, the engine is employed as a working fluid and is caused to flow into the high-temperature side heat exchanger 24 of the prime mover 22, and the low-temperature side heat exchanger 25 is caused to have a temperature difference of about 100 degrees C. relative to the high-temperature side heat exchanger 24, thereby generating acoustic waves from the low-temperature side heat exchanger 25 through the stack 26 and the high-temperature side heat exchanger 24. Such acoustic waves are then transmitted to the pipeline 21*b* on the heating device 23 side via the pipeline 21*a* on the prime mover 22 side. Thus, it is possible to use the high-temperature side heat exchanger 27 of the heating device 23 as a heat source.

In this instance, streaming occurs in the prime mover 22, but the low-temperature side heat exchanger 28 of the heating device 23 can receive heat generated by the streaming because the low-temperature side heat exchanger 28 is integrally formed with or held in contact with the pipeline 21*a* of the prime mover 22 side. Accordingly, not only can the streaming, which flows into the pipeline 21*a* on the downstream side thereof, be suppressed, but the high-temperature side heat exchanger 27 can also recover the heat generated by the streaming.

The invention claimed is:

1. A thermoacoustic heating device, comprising:

two pipelines, each including a loop;

a branch pipeline connecting the two loop pipelines; and a prime mover provided in one of the two loop pipelines, wherein a heating device is provided in the other of the two pipelines, wherein the heating device includes a high-temperature side heat exchanger, a low-temperature side heat exchanger and a stack for connecting the high-temperature side heat exchanger to the low-temperature side heat exchanger, wherein the high-temperature side heat exchanger is at a higher temperature than the low-temperature side heat exchanger, wherein the branch pipeline is bent at an intermediate portion thereof such that the loop pipeline on the heating device side is positioned adjacent to the branch pipeline on the prime mover side, and wherein the low-temperature side heat exchanger of the heating device is integrally formed with or held in contact with the branch pipeline on the prime mover side.

2. The thermoacoustic heating device according to claim 1, wherein the prime mover includes a high-temperature side heat exchanger, a low-temperature side heat exchanger and a stack for connecting the high-temperature side heat exchanger to the low-temperature side heat exchanger.

3. The thermoacoustic heating device according to claim 2, wherein the high-temperature side heat exchanger of the prime mover receives exhaust gas from an internal combustion engine.

4. The thermoacoustic heating device according to claim 2, wherein the high-temperature side heat exchanger of the prime mover has a predetermined temperature difference relative to the low-temperature side heat exchanger of the prime mover to generate acoustic waves.

5. The thermoacoustic heating device according to claim 4, wherein the predetermined temperature difference is 100 degrees C.

* * * * *